US005950828A

United States Patent [19]

Bal

[11] Patent Number: 5,950,828

[45] Date of Patent: Sep. 14, 1999

[54] TOOLING UTILITY SYSTEM

[76] Inventor: Gregory W. Bal, 160 Spring Valley Rd., Montvale, N.J. 07645

[21] Appl. No.: 08/994,227

[22] Filed: Dec. 19, 1997

[51] Int. Cl.[6] ..... B65D 85/20; B65D 85/62; B65D 21/02

[52] U.S. Cl. ..... 206/370; 206/373; 206/379; 206/503; 220/4.27; 220/23.6

[58] Field of Search ..... 270/4.27, 4.26, 270/23.4, 23.6; 206/372, 373, 379, 503, 504, 508, 509, 511, 370, 369, 363

[56] References Cited

U.S. PATENT DOCUMENTS

| | | | |
|---|---|---|---|
| 2,840,256 | 6/1958 | Cobb, Jr. | 220/4.26 |
| 4,458,815 | 7/1984 | Mollman et al. | 206/511 |
| 4,501,355 | 2/1985 | Hoffman | 206/503 X |
| 4,619,363 | 10/1986 | Wolfseder | 206/503 X |
| 5,004,103 | 4/1991 | Connors et al. | 206/372 |
| 5,215,776 | 6/1993 | Kudla et al. | 206/370 X |
| 5,279,800 | 1/1994 | Berry, Jr. | 206/370 X |
| 5,281,400 | 1/1994 | Berry, Jr. | 206/370 X |
| 5,284,632 | 2/1994 | Kudla et al. | 206/370 X |
| 5,340,551 | 8/1994 | Berry, Jr. | 206/370 X |
| 5,421,455 | 6/1995 | Clatanoff et al. | 206/509 X |
| 5,433,929 | 7/1995 | Kiihmaki et al. | 206/370 X |
| 5,720,930 | 2/1998 | Bear | 206/370 X |

FOREIGN PATENT DOCUMENTS

| | | | |
|---|---|---|---|
| 2139666 | 2/1973 | Germany | 220/4.27 |
| 0194313 | 2/1938 | Switzerland | 220/4.27 |

*Primary Examiner*—Bryon P. Gehman
*Attorney, Agent, or Firm*—W. Patrick Quast, Esq.

[57] ABSTRACT

A tooling utility system especially well suited for punches and dies employed in pharmaceutical tableting procedures is described. Punch trays, nesting one on top of another, have support rails with oppositely positioned arcuate cut-outs which provide nesting segments for securing the punches during transport and storage. Dies, placed within a cavity including a die support, are similarly secured in position. A substantial portion of the surface area of the punches and dies remain fully exposed, making for simplified inspection and cleaning procedures, including placing the vertically nesting trays directly into a sonic cleaner. The trays themselves form the outer structure of the tool system, secured together by hinged side covers or front and back snap on side covers. A unique tongue and groove interlocking arrangement is described which is disposed upon the top and bottom surfaces of the trays. The tongue and groove arrangement allows for the trays to be orientated in either one of two positions; and when empty, to permit placement on either side upon a lower tray in the stacking. The described system allows for a varied number of trays to be used to handle different size sets of tooling.

23 Claims, 14 Drawing Sheets

TOOLING UTILITY SYSTEM

BACKGROUND

This invention relates to a utility system for tooling, and in particular for punches and dies used in conjunction with pharmaceutical tablet press machinery.

Tablet press machinery utilized in pharmaceutical manufacturing requires a relatively large number of punches and dies for compressing the tablets. Typically forty-five or more dies per tablet press will be employed, with double the quantity for the corresponding punches. Two punches precision machined to yield the size and shape of the particular tablet to be manufactured are required for each precision machined die which holds the powder to be compressed into the tablet form. The actual functioning of the tablet press is well known to the art, and forms no part of this invention.

The large number of these precision machined metal punches and dies obviously require a compact and convenient placement system to prevent damage to these delicate tools during storage and cleaning, and to provide ready access when required for use in a tablet press. Attempts have been made in the past to provide suitable storage containers as is evidenced by Williams, U.S. Pat. No. 4,489,994, issued Dec. 25, 1984. Williams teaches a tool box for holding matched sets of punches and dies for pharmaceutical tablet manufacture. Punches 46 (FIG. 2) are secured in individual nests on a tray 68 (FIG. 3) horizontally positioned within the storage cabinet 20 (FIG. 1). Trays are positioned vertically one above another within the cabinet, with a sliding door in the cabinet providing access to the trays and/or individual punches. Dies 64 (FIG. 2) are stored separately in a drawer 76 at the base of the cabinet. In a second modification provisions for storing additional punches vertically positioned in the front doors of the cabinet is described. Again, Connors et al, U.S. Pat. No. 5,004,103, issued Apr. 2, 1991, teach a storage and tote box for punches and dies for the production of tablets and caplets. In this storage box 1 (FIG. 1) a removable tray 2 has a plurality of through holes 9 (FIG. 4) arranged in a grid in order to support the punches P (FIG. 3) in a vertical position by means of their head portion H. Cylindrical guide means 11 (FIG. 5) within each hole, together with a notch 12 in the tray and a key K on each punch, prevent movement of the punches during storage. A guide rail 4 (FIG. 3) around the periphery of the gridwork of the trays provides the means for accommodating the associated dies D1.

While these inventions provide useful means for storage of punches and dies employed in pharmaceutical manufacture, they do not address the multiple purposes envisioned by the tooling utility system of the present invention.

Therefore it is a primary object of the present invention to provide a tooling utility system to store, for example, punches and dies utilized in pharmaceutical tablet manufacture, in a safe, convenient, easy-to-use and economical manner.

It is a further object to provide a tooling utility system for containing punches and dies for pharmaceutical tablet manufacture comprising a set for a specific application.

An additional object of the invention is to provide a tooling utility system for either vertical or horizontal placement of the stacked trays.

Still another object to the invention is to provide a tooling utility system for safely shipping complete sets of tooling.

Yet another object of the invention is to provide a tooling utility system wherein tooling secured on trays within said system are fully visible and accessible for manual or automatic inspection.

An additional object of the invention is to provide a tooling utility system wherein trays within said system on which said tools are positioned are designed to be placed within a container for sonic cleaning procedure without the need for extraneous handling tools.

A still further object of this invention is to provide a tray design for storing tooling which permits the tooling to be stored on either side of individual trays and which permits the stacking of the trays in any orientation thus optimizing the simplicity and flexibility of the tooling utility system.

SUMMARY

These and other objects are obtained with the tooling utility system of the present invention.

Metal precision made tooling generally tends to be expensive and prone to damage, necessitating reasonable care while being stored prior to use. This is especially true for punches and dies used in pharmaceutical tablet manufacture. For the production of each tablet shape and weight a large number of precision machined dies to hold the powder to be compressed into a tablet are almost invariably required. In addition, traditional automatic tablet presses require two precision machined punches to cooperate with each die in the manufacture of a particular tablet. Typically the number of punches and dies required for each tableting procedure number a hundred or more tools. To store these tools compactly and securely, with the tools being easily identified and readily accessible therefore presents unique challenges.

It occurred that maintaining the tools securely with as much of the surface area as possible of the punches and dies exposed would present an ideal storage container for identification, inspection, cleaning, and other maintenance procedures as required. Punches typically employed in tableting procedures have an enlarged head portion relative to a cylindrical body portion, with a narrower cylindrically shaped neck portion extending from the base of the body portion which contains the shaped area for forming half of the tablet shape. Dies are typically circular in shape, with a precision bore through a center area into which the neck portion of the punch will be inserted during tableting operations.

The tooling utility system of the invention as applied to pharmaceutical tableting punches and dies is comprised of five main components: at least one tooling tray, punch and/or die, a base cover, a top cover, and two side cover-handles. Punch and die trays nest together one on top of another, the side walls of the trays actually forming the four sides of the system. Usually there would be at least several punch trays for each die tray. The top and bottom surfaces of the perimeter walls of the die and punch trays are formed to include cooperating alignment means to facilitate stacking. Specifically, a tongue and groove design is described which together with the fact that the interior design of the punch trays permits placement of the punch tooling on either side of the tray, permits the indiscriminate placement of either storage side of an empty punch tray upon a lower tray while providing a stable interlock between the trays. The die tray typically might be positioned on the base cover, with the punch trays being placed in vertical alignment above the die tray. Another disclosed design for the die tray facilitates its placement on the top of the stacked trays, under a top cover including a recessed area to enclose the exposed portion of the dies. A top cover would then be placed on the top surface of the uppermost tray. Finally, the side cover-handles including means for attaching to cooperating members of the left and right sides of the stacked tray arrangement form the tooling utility system of the present invention.

The trays for punches have a rectangular shape, having narrow front and back side walls relative to the left and right side walls, the height of the tray frame walls being approximately 1". Convenient hand grip cut-outs are provided in the front and back side walls of each tray. To form an open framework for securing the punches, two support rails are connected between the front and back side walls of the tray, each support rail spaced a relatively short distance (approximately 1.5") from opposite sides of the tray. If, for example, the tray is designed to hold 10 punches, then each of the support rails will have 10 arc segments cut into their top surface, and 10 arc segments cut into their bottom surface, the radius of the arc segments corresponding to the radius of the circular body portion of the punch, and therefore forming nesting surfaces for the punches. Each top are segment is positioned opposite each bottom arc segment on each support rail, with the support rails and their respective arc segments being positioned parallel to each other within the tray. The side walls of the tray and support rails are given further rigidity by having 18 outside rail support web structures, nine of which laterally interconnect the left side wall to the first support rail, with the other nine sections laterally interconnecting the right side wall to the second support rail. Four inside rail support web sections complete the punch tray structure, the four sections laterally interconnecting the first and second support rails at spaced distances along the width of the tray. Constructed in this fashion the punch tray will secure 10 punches horizontally positioned on each pair of oppositely positioned nesting surfaces in the support rails. The punches will now sit in nesting surfaces, half of the punch being above the top surface of the tray. Virtually the entire surface area of the punch is exposed, with only a small area of the body portion in contact with the surface of the nesting arc, away from irregular shapes such as the enlarged head portion, the neck portion, stem or keyed portion. hen a second punch tray is now placed on top of a fully loaded first punch tray, the nesting arcs on the bottom of the support rails in the second tray will now sit over the punches that are half out of the first tray forming a clamping action, and concealing the punches within the outer walls of the adjoining trays.

The top and bottom surfaces of the outer walls on opposing sides are formed in a tongue and groove configuration, which allows either side of the tray to be used as a nesting place for the tooling, and for each tray to fit together in any orientation when stacked.

The die tray is fabricated similarly to the punch tray, having the same dimensioned front and back walls, left and right side walls, formed with tongue and groove surfaces for ease of stacking and with cut-outs for convenient hand grasping. A cross web structure provides the means for securing the dies in place. If, for example, 36 die cavities are required in the one die tray, 36 squares to hold the dies are formed by having three, length support web sections running the length of the tray, with eight, width support web sections running the width of the tray. The intersections of the length and width support web sections, together with the inner walls of the tray frame, now provide 36 square areas in which to place each of the dies. A minimal space consuming means for providing a base support for the dies, such as, for example, two cross web sections diagonally positioned at the base of each cavity, complete the structure of the die tray.

One version of the side cover-handles is disclosed wherein the side cover-handles are hingedly attached at their bottom to both the front and back edges of the base cover. A detent projection at the top of each side cover handle engages a cooperating aperture in a detent holder extending outwards from both the front and back edges of the top cover when the side cover-handles are pivoted upwards about their hinged connection at the bottom.

In a second version, a detent projection is affixed to both the front and back edges of both the base cover and the top cover. Front and back edge side cover-handles having cooperating apertures with detent retention means at their top and bottom ends snap fit onto the detent projections to secure the trays together into one system. Additionally, the front and back edge side cover-handles can have oblong shaped projecting panels designed to fit into the oblong shaped hand grasping cut-outs formed on the front and back sides of each of the trays. The side cover panel projections can have grooves and ridges cut into the hemispheric ends of each of the oblong projections which, when inserted into cooperating grooves and ridges at the hemispherically shaped ends of the hand grip cut-outs in the trays, firmly locks each tray into position when the front and back side cover panels are snapped in place on the front and back edges of the tray.

Thus it can be seen that a unique new convenience in the storage and use of precision tools, especially as they relate to pharmaceutical tablet production, is provided by the present invention of a tooling utility system. The trays, covers and side covers can be fabricated in wood, metal, or economically in injection molded plastics. The following advantages of the invention are apparent.

Inspection

1. One tray at a time can be worked on in an organized fashion.
2. Trays and nestings can be numbered.
3. Punches are held horizontally, half out of each tray for easy visibility and accessibility (one can rotate a punch with one finger in its nesting place and view the complete punch at a glance, never having to pick it up).
4. Trays are designed for automated inspections. Punches are held half out of the tray are in a precise position, easily picked up by an automated picker. The trays themselves can be easily conveyed.

Cleaning

1. Hand cleaning methods are greatly simplified.
2. The open inside structure of the trays makes possible the submergence of multiple stacks of trays into a sonic cleaner as a complete unit.

Set-up

1. Numbered trays make reinstallation of keyed tooling very easy.
2. Trays are already designed for automated installation.
3. An empty symmetrical tray can be flipped over and stacked, ready to accept tooling.

Storage

1. Punches and dies are firmly locked in place.
2. The tooling utility system can be designed to hold a varied amount of tools needed to form a particular set.
3. The tooling utility system can be stored horizontally or vertically, whatever is best for space saving.

Manufacture and Shipment

1. In automated manufacturing procedures trays can be used to convey parts during final grinding, polishing and quality control inspection.
2. Trays stacked and secured as a system are ideal for shipment because of its ability to isolate individual tool pieces, thus protecting them from damage in transit.

DETAILED DESCRIPTION

Figure 1:
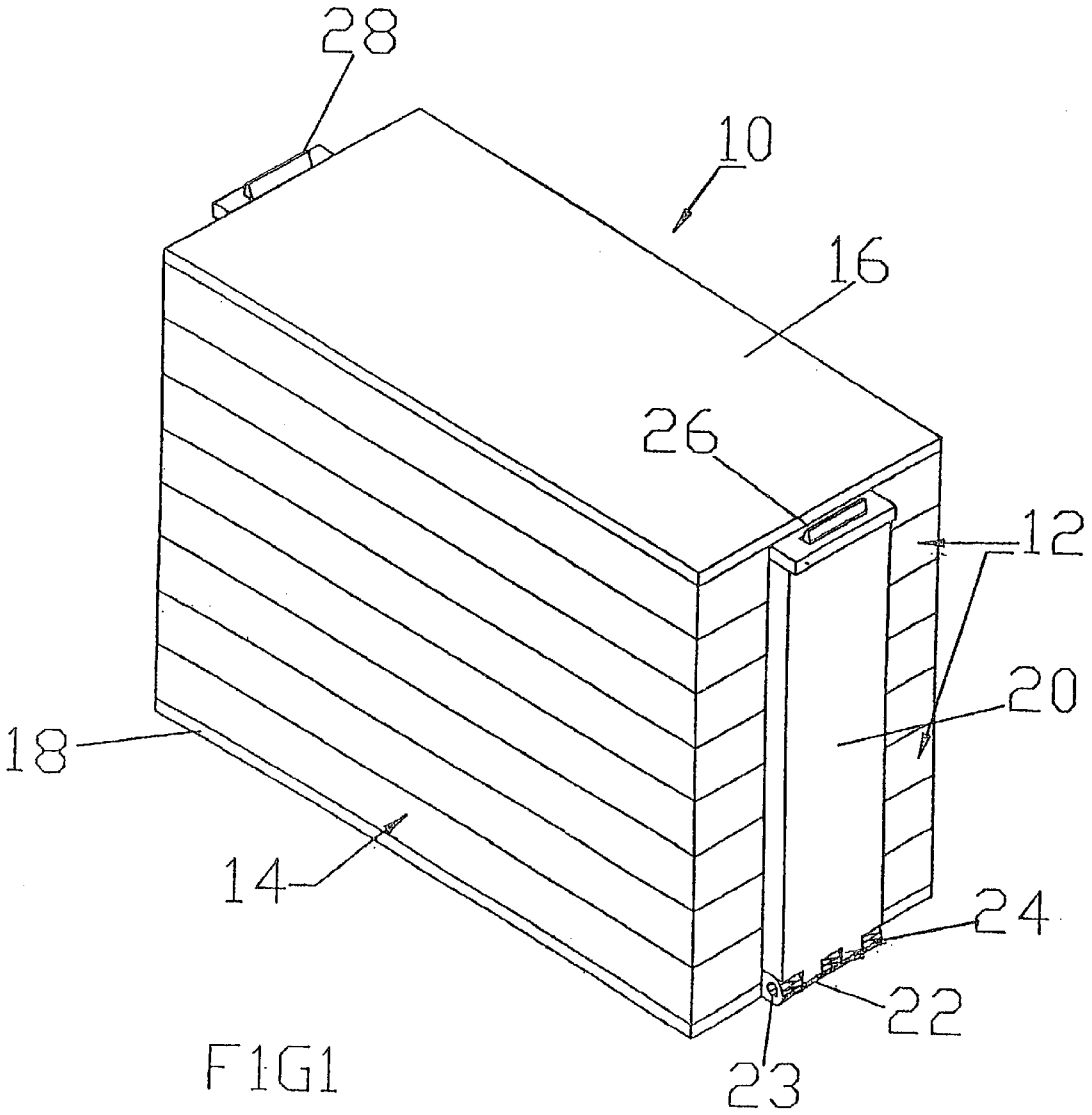
FIG. 1 is a perspective view of one embodiment of a complete version of the tooling utility system of the invention.

Turning now to the drawings wherein similar structures having the same function are denoted with the same numerals, in FIG. 1 one version of a complete tooling utility system 10 of the invention is illustrated. A dimension for such a system might be, for example, approximately 12" in length by 5½" in width and 8" in height. The examples depicted in FIGS. 1–14 are primarily for securing punches and dies utilized in pharmaceutical tablet production, but obviously the open inside structure of the invention for ease in tool inspection and cleaning will be a significant convenience for any number of other precision tools. The system 10 is illustrated having punch trays 12 nesting one on top of another, with a die tray 14 being at the base of the vertical column of trays. A base cover 18 forming the bottom of the system 10, and a top cover 16 forming the top of the system, are secured together with a side cover-handle 20 on both the front and back sides of the system.

Figure 2:
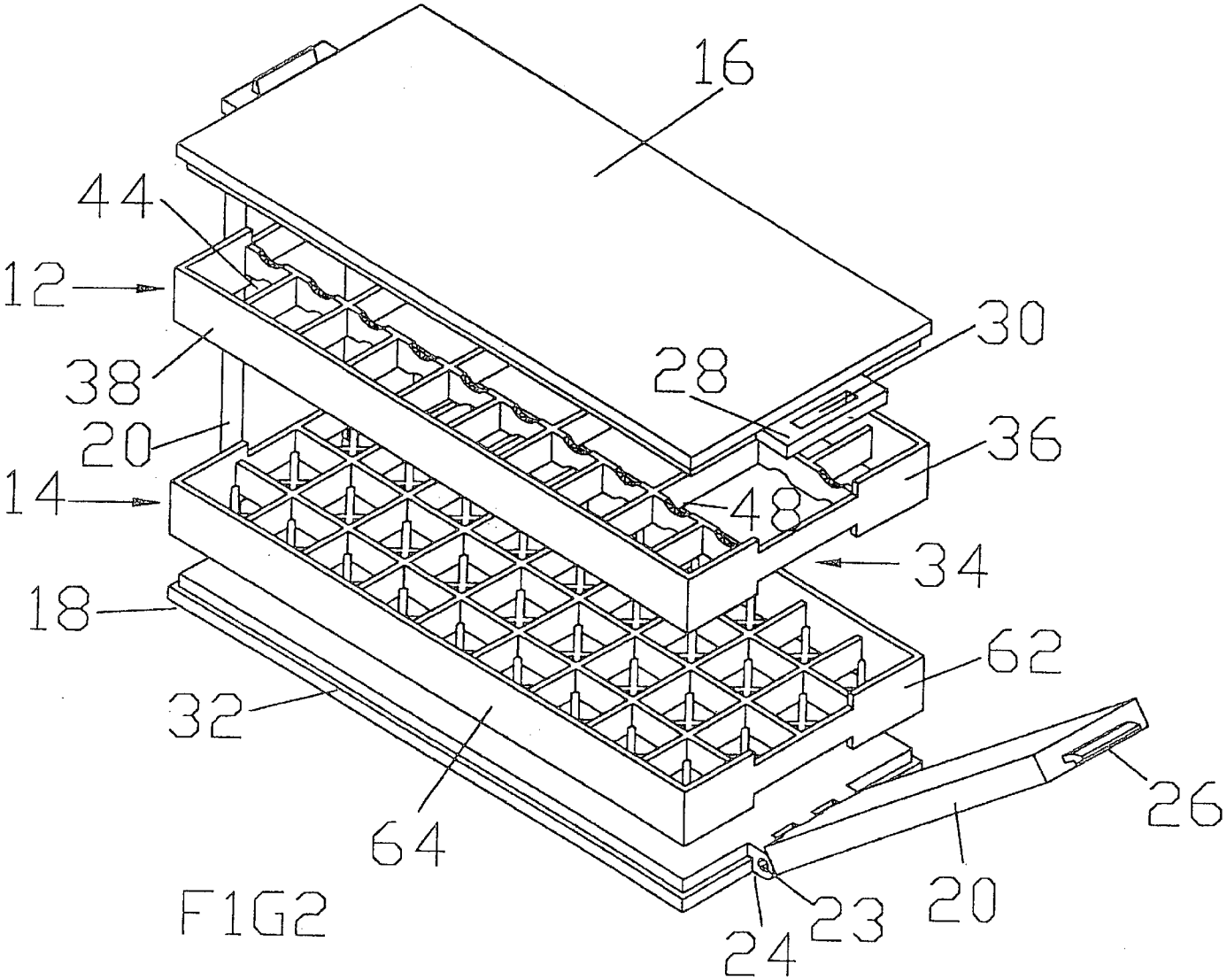
FIG. 2 is an exploded partial view of FIG. 1, illustrating the relative position of the punch and die tray within one version of the tool utility system of the invention.

As best seen in FIG. 2, the punch trays 12 are positioned nesting vertically one on top of another. A die tray 14 is shown positioned at the bottom of this vertical arrangement of punch trays, although, of course, it could be positioned at any level of the vertical arrangement. An L shaped recessed area 32 around the periphery of the inner side of both the base cover 18 and the top cover 16 provide a convenient slip over connection for the periphery of the base of the die tray and the periphery of the top of the uppermost positioned punch tray. Side cover-handles 20 are hingedly affixed to both the front and back edges of the base cover 18 via two apertured arms 22 extending therefrom at a base portion thereof. Three apertured arms 24 extend forward of the front and back, bottom cover edges. A hinge pin 23 passing through successive arms 23 and 24, hingedly secure the base portion of each side cover-handle to the respective front and back edges of the base cover 18. A detent projection 26 extending upwards from the top surface of each of the side cover-handles 20 provides the means for securing the trays and covers together to create a sealed system. With the trays nesting together in a vertical column, and with the top and bottom covers in place, the side cover-handles on both the front and back sides of the base cover are swung upwards, the detent projection 26 on the top surfaces of the side cover-handles being snap fitted into a cooperating aperture 30 within a detent holder 28 extending outward from the front and back edges of the top cover. This action firmly secures the trays and covers together into a sealed tooling utility system, which may then be stored vertically or horizontally depending on available space requirements.

Figure 3:
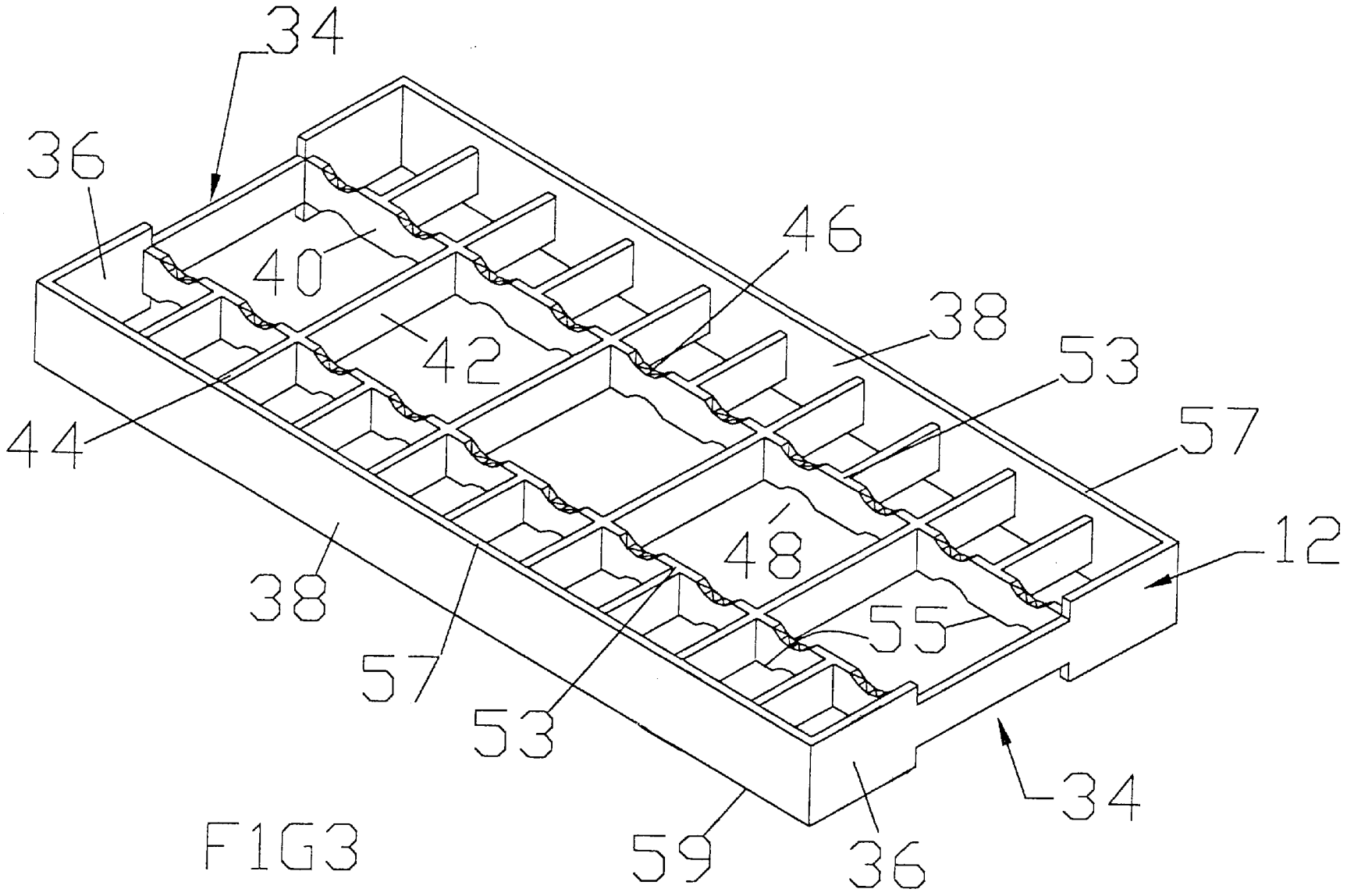
FIG. 3 is a perspective view of one version of the punch tray of the invention.
Figure 4:
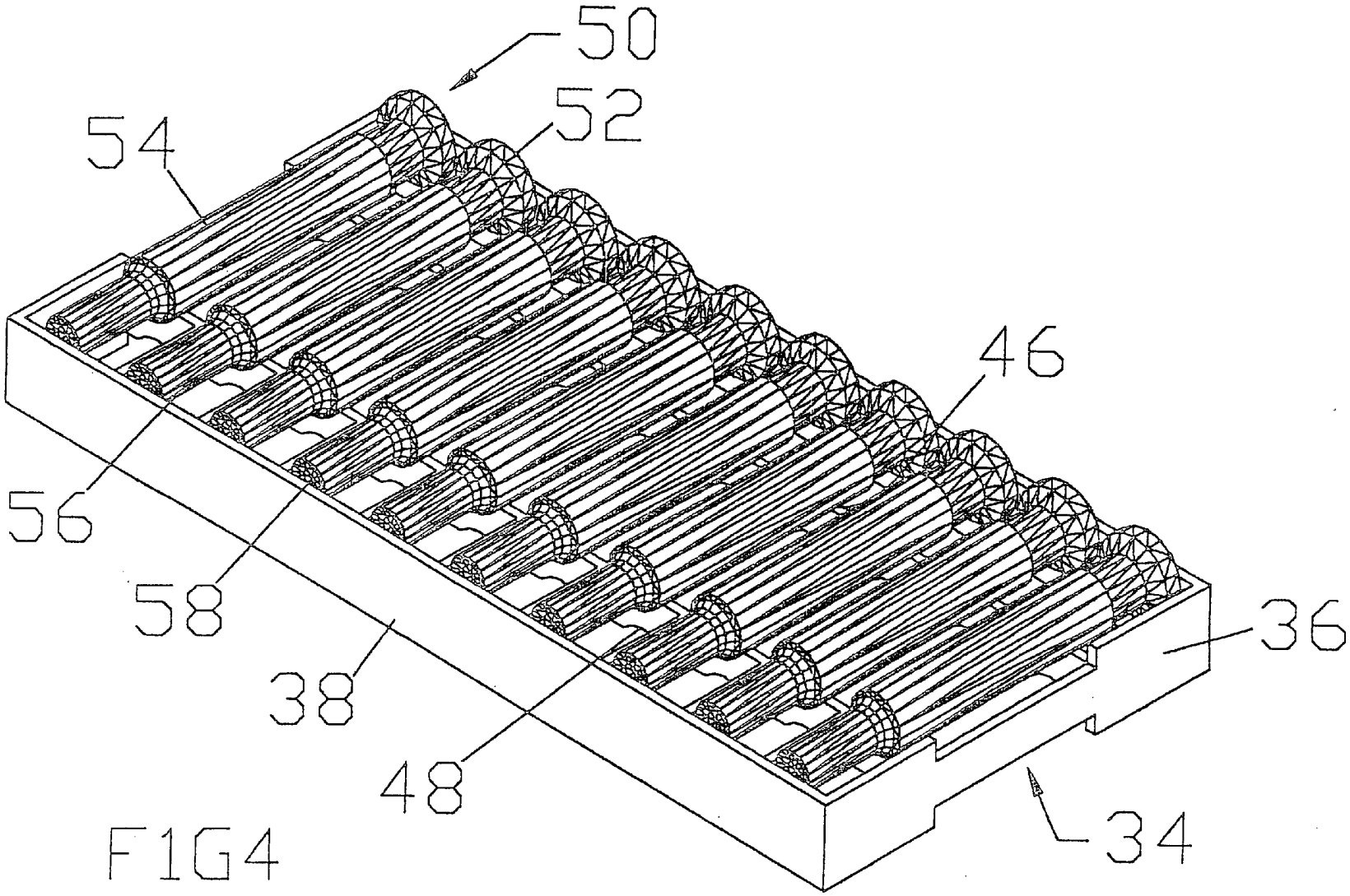
FIG. 4 is a view similar to that of FIG. 3 illustrating the placement of punches within a punch tray.

FIGS. 3–4 give details of one version of the punch tray of the invention. The example given is a tray 12 for holding ten punches for tableting applications. The rectangularly shaped tray 12 has front and back side walls 36 being narrow in relation to the left and right side walls 38. The tray dimensions can be 12" in length, 5.562" in width, and 1.062" in height, having a perimeter wall thickness of 0.125". Both the front and back side walls 36 have cut-outs 34 to conveniently facilitate hand grasping of each tray or trays when stacked. To create the open structure of the tray two support rails 40 are positioned vertically within the tray and parallel to each other, being affixed at each end of the support rails to the front and back side walls 36 of the tray. Each support rail is positioned approximately 1.5" away from the left and right side walls 38. Eighteen outside rail support web structures 44 (FIG. 4), interconnect the inner surface of the left and right side walls of the tray to the facing vertical surface of the support rails 40, with nine outside rail support web structures positioned on one side of the tray, and the other nine on the opposite side of the tray. The outside rail support web structures define respective nesting areas for the head and neck portions, 52 and 56, of each punch. To further stiffen the internal structure of the tray, vertically positioned inside rail support web structures 42 spaced equidistantly apart, laterally interconnect the two support rails 40.

Ten circle segments 46 are cut into the top surface of each of the support rails 40, and ten circle segments 48 are cut into the bottom surface of each support rail, the circle segments in the tops and bottoms of each support rail being opposite each other, and positioned parallel to the circle segments in the other support rail. In this manner ten sets of nesting, arcuate segments are created for the ten punches. In FIG. 4, ten punches 50 are shown disposed on the nesting, arcuate segments.

Figure 4A:
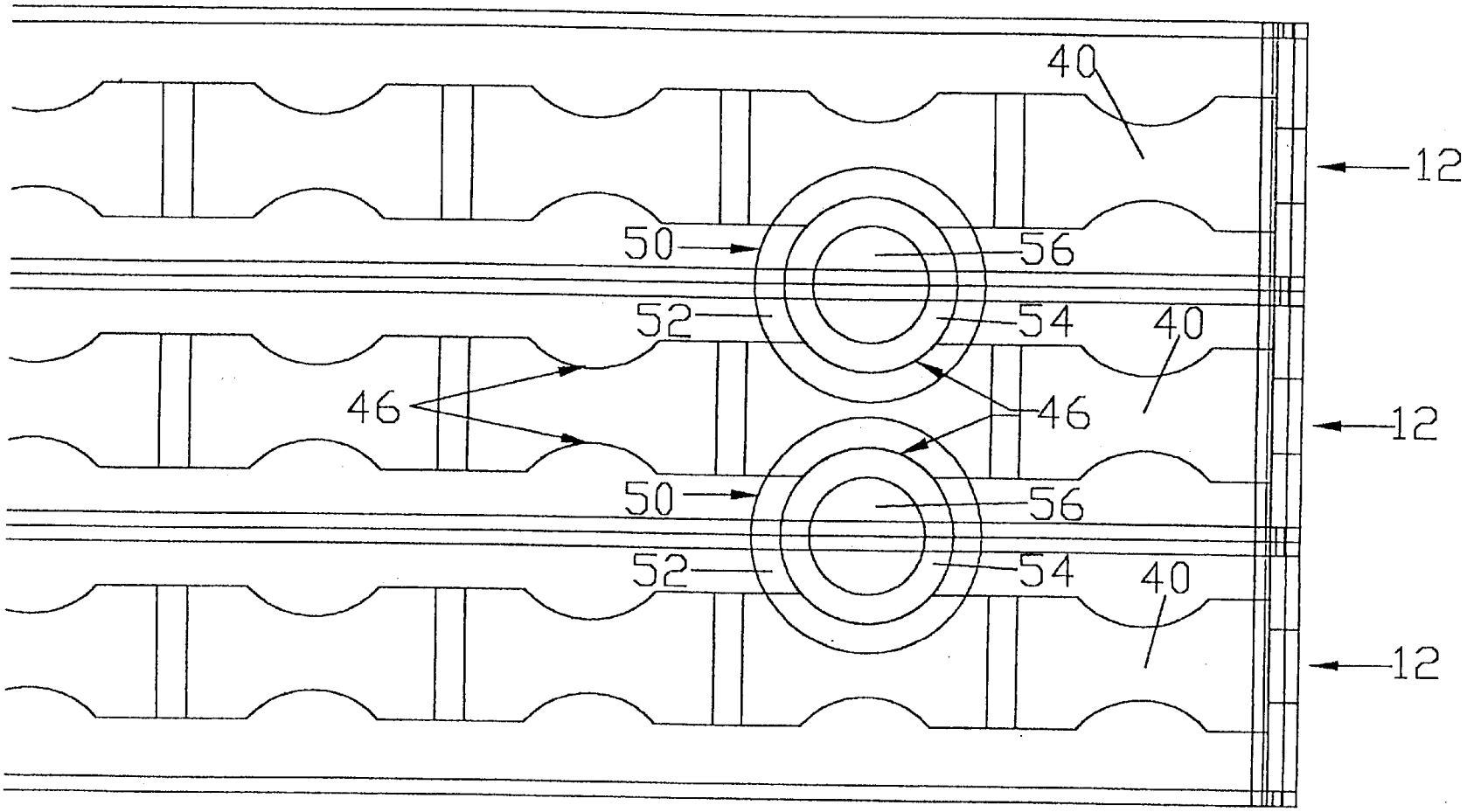
FIG. 4A is a side, elevation view depicting the relationship of vertically adjacent punch trays with punch tooling in place.

A typical punch for pharmaceutical tableting procedures is comprised of an enlarged head portion 52, a cylindrical body portion 54, and a narrower cylindrically shaped neck portion 56. An aperture 58 within the neck portion is the shaped area for forming half of each tablet when two punches compress the powdered material within the die. As can be seen in FIGS. 4 and 4A, the punch is supported only on its body portion 54.

The nesting segments are designed so that their radius is half of the diameter of the punch body portion 54; and the dimensions of the two support rails 40 including the distance between the planes of their top and bottom surfaces 53 and the planes of the top and bottom surfaces 57 and 59 of the perimeter walls are such that when the punch is disposed on its set of nesting segments, half of the punch projects above the upper surface of the outer walls of the tray. A substantial portion of the surface area of the punch 50 (which is also true of the die as will be discussed below) is therefore exposed for inspection and cleaning procedures. When a second identical punch tray is secured over this first punch tray, the bottom nesting segments in this second tray will sit over the punch that is half out of the first tray, forming a clamping action and restraining the punch within the top and bottom halves of adjoining trays as well as concealing them from view.

Figure 5:
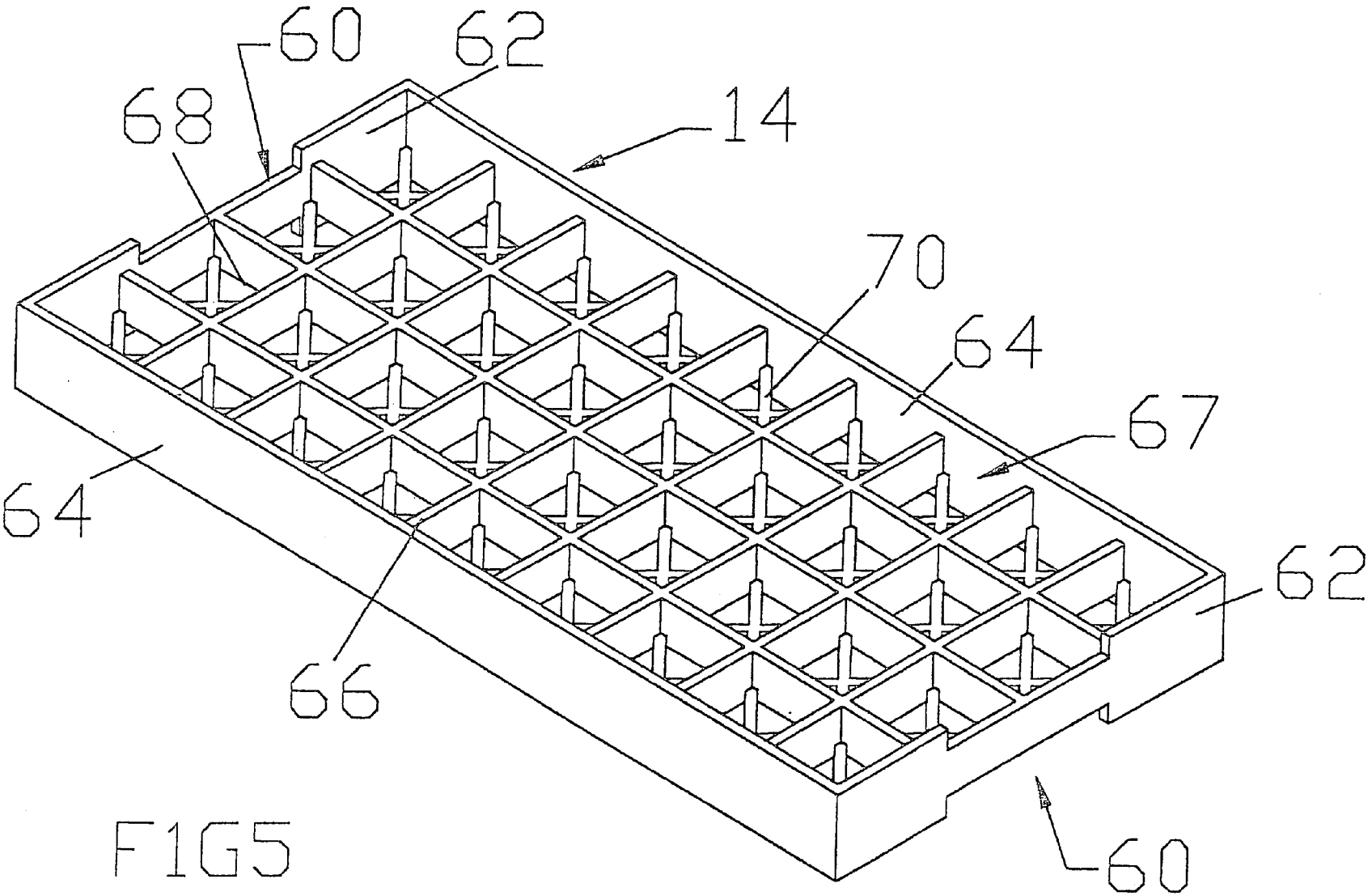
FIG. 5 is a perspective view of one version of the die tray of the invention.
Figure 6:
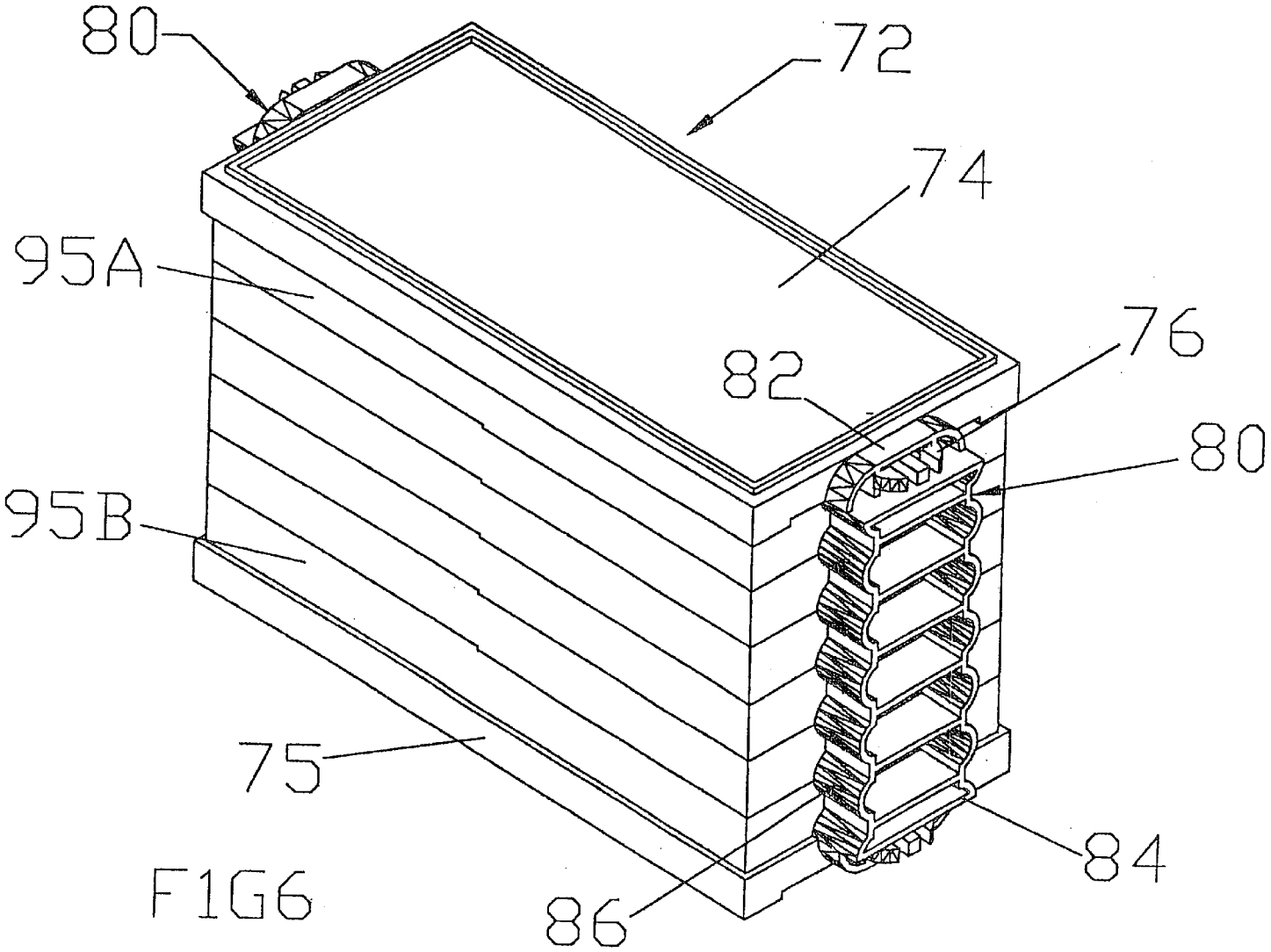
FIG. 6 is a perspective view of a second embodiment of the tooling utility system of the invention.
Figure 7:
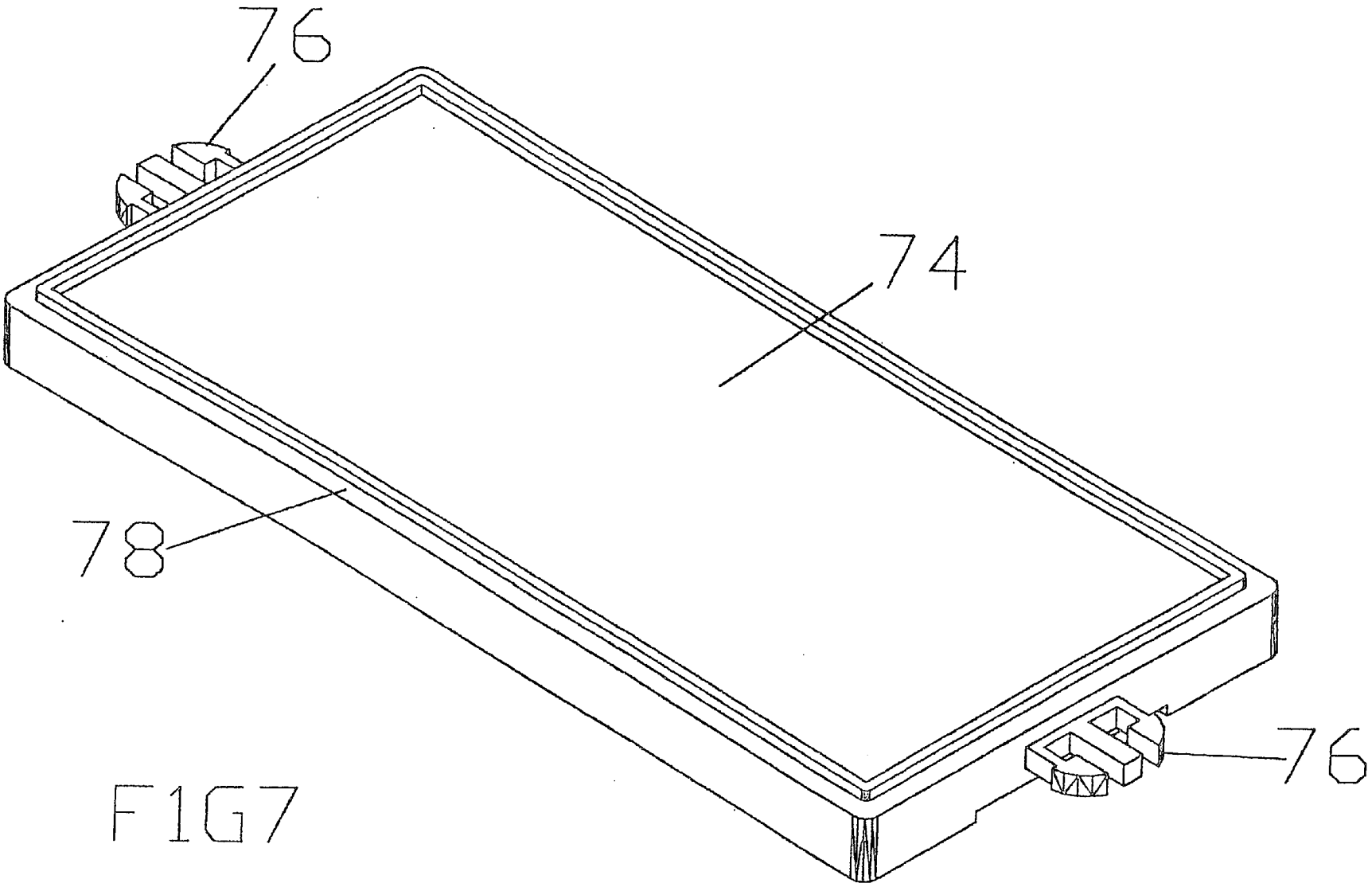
FIG. 7 is a top plan view of the bottom cover of the tooling utility system of FIG. 6.

FIG. 5 provides a detailed view of a possible die tray 14 compatible with the above described punch trays. The die tray 14 has the same outside dimensions as the punch trays described above, with the same dimensions for the front and back side walls 62, the left and right side walls 64, and the hand grip cut-outs 60 in both the front and back side walls. The dies (not shown) are held in open structured cavities 67 formed by the intersection of three length support web sections 68 and eight width support sections 66. The three vertically positioned length support web sections are equidistantly affixed along the length of the tray 14, with the eight vertically positioned width support web sections 66 equidistantly affixed across the width of the tray. The intersections of the length and width support web sections form thirty six hollow cavities for the placement of the dies therein. Two cross web structures 70 connect diagonally across the base of each cavity, being affixed at each end to a corner of the square shaped cavity 67, so as to provide a minimally area consuming stop for the die within the cavity. When a punch tray 12 is placed on top of the die tray 14, and the top and base covers put in place, and the side cover-handle secured, the dies are similarly held firmly in place as is the case with the punches 54, and similarly a substantial portion of the surface area of each die is exposed for inspection and cleaning purposes.

Figure 8:
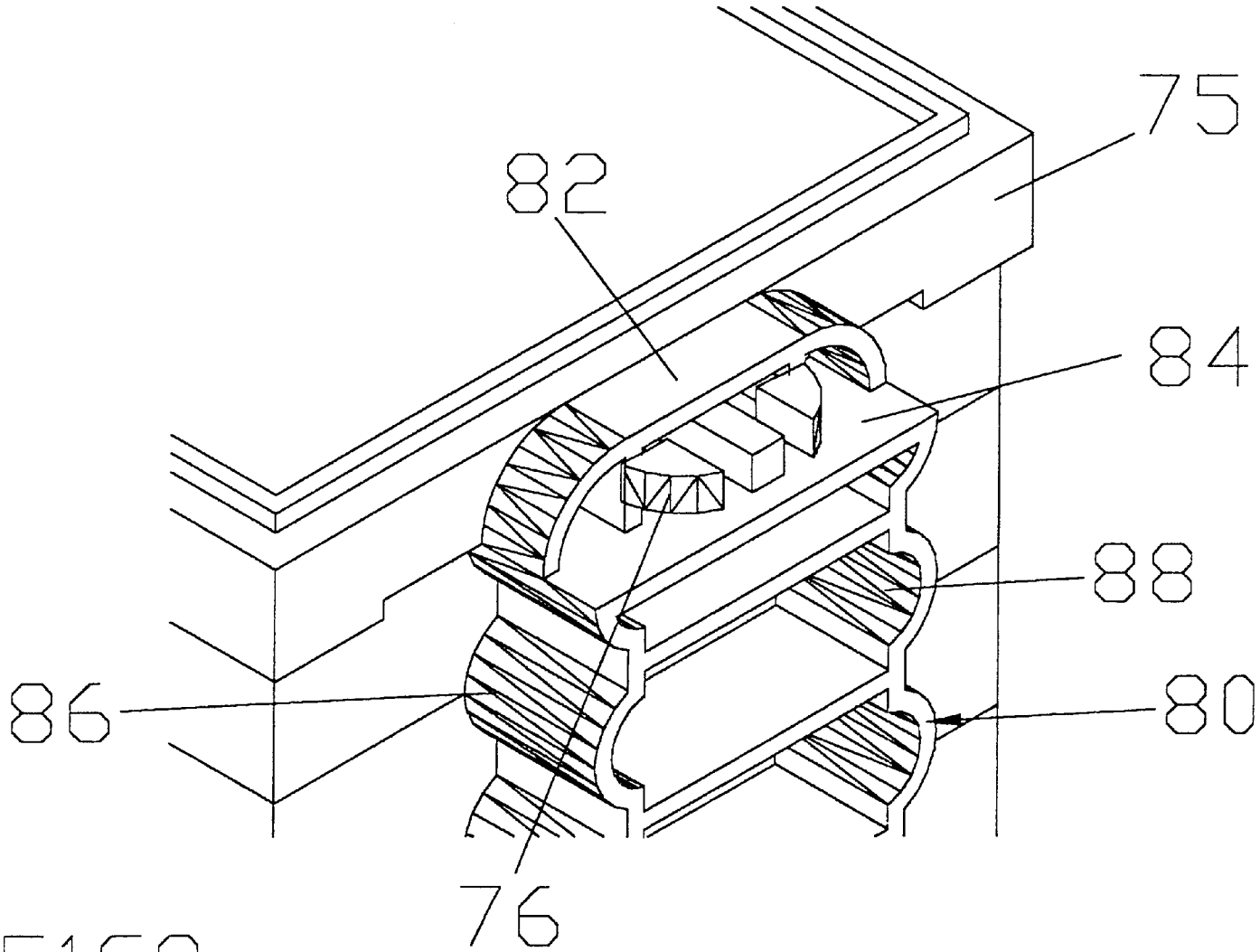
FIG. 8. is an enlarged view of a top cover and side cover-handle of the tooling utility system of FIG. 6.
Figure 9:
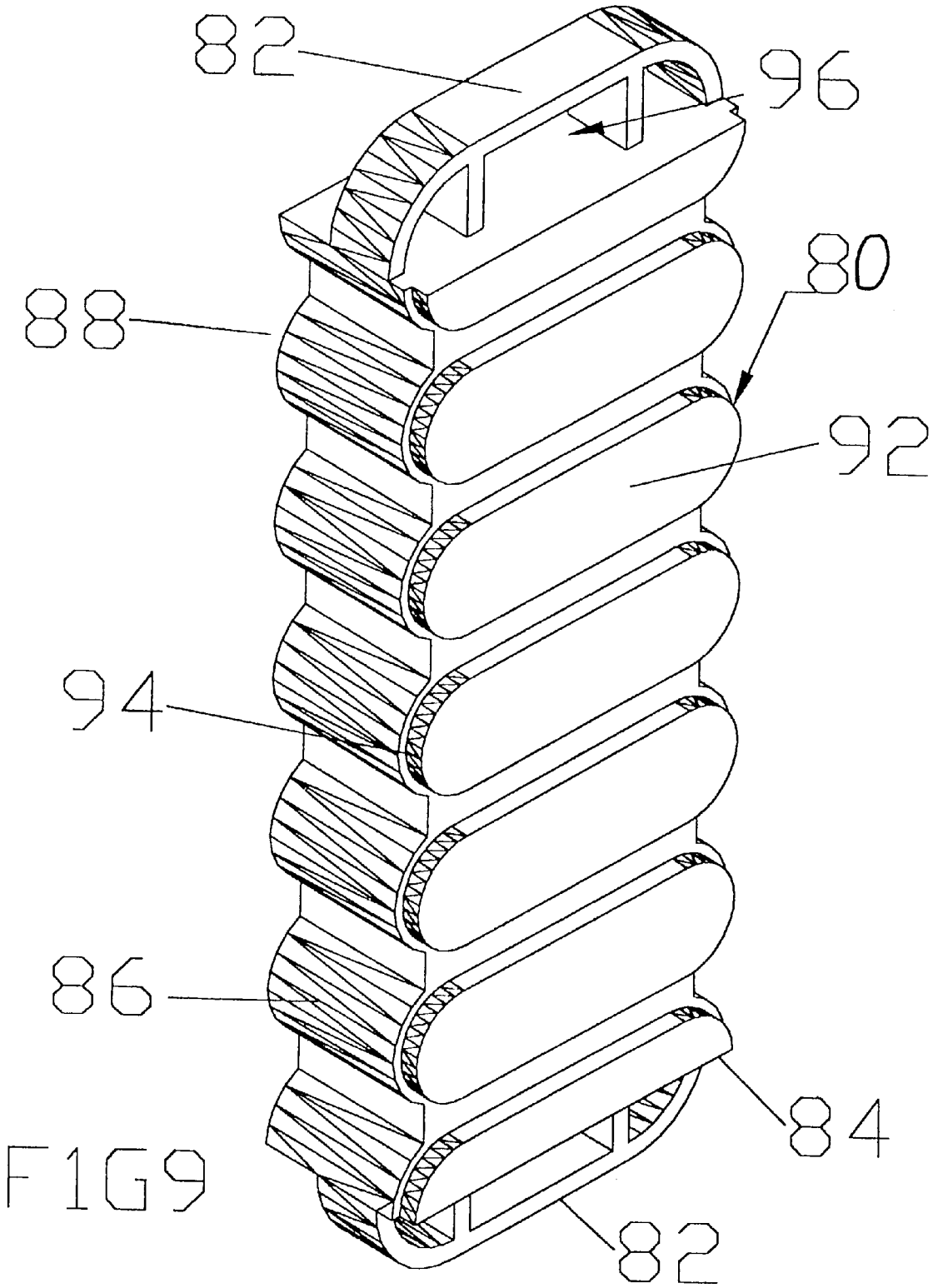
FIG. 9 is a perspective view of the rear side of the cover-handle illustrated in FIGS. 6 and 8.
Figure 10:
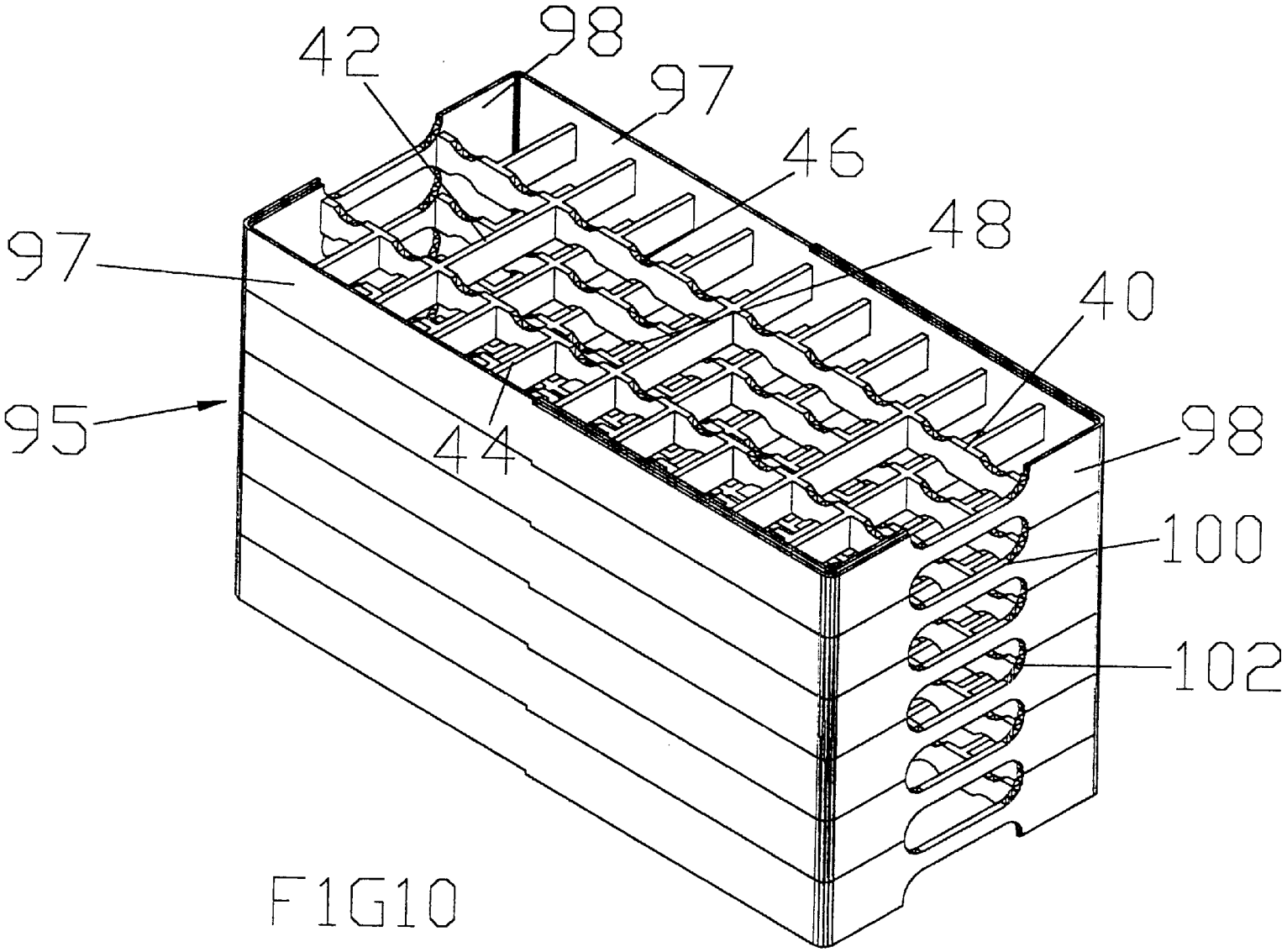
FIG. 10 is a perspective view of the nesting feature of the trays of the tooling utility system of FIG. 6, illustrating the grooved edges of the hand grip opening in adjacent trays.

FIGS. 6–10 disclose a similar tooling utility system 72 to the above described tooling system 10 except that a different mechanism is employed to secure the trays together into a sealed tooling system. In this case both the top and base covers 74 are identical, having an L shaped recessed area around their inner surface peripheries so as to accommodate the peripheral edges of either the top of a punch tray 95A or the bottom of a die tray 95B. On both the front and back edges of the covers 74 a pair of detent projections 76 extend outwardly. As best seen in FIGS. 8 and 9 a pair of identical front and back edge side cover-handles 80 provide the means for securing the top and bottom cover and vertical column of trays firmly together into a sealed system. A pair of detent holders 82, having a cooperating aperture 96 therethrough, is affixed to both the top surface and bottom surface 84 of the side cover-handle 80. The height of the side cover-handles 80 is approximately the same as the height of the front and back of the combined top and base cover and trays so that when brought together the detent projections 76 on the covers snap fit into the apertures 96 within the side cover-handle detent holders 82, thereby creating an integral, sealed tooling utility system 72. As an added convenience the portion of the side cover-handles facing away from the trays can have a grid work forming slots 88 to facilitate the placement of fingers for carrying the integral system. For additional security, the opposite face of the side cover-handles can provide added storage and transportation security for the trays 95A, 95B, by having a series of oblong shaped panels 92 projecting outwardly from each side cover-handle. These oblong shaped panels 92 exactly match oblong shaped cut-outs 102 formed when the hand grasping cut-outs in one tray align with the hand grasping cut-out in the tray below. The trays 95A, 95B employed in this case are similar to the previously described trays, with a narrow front and back wall 98, and longer left and right side walls 97. They differ from the previously described trays in that the hand grasping cut-outs have hemispherically shaped lateral edges 100 grooved and ridged to cooperate with grooved and ridged hemispherically shaped lateral edges 94 on the oblong shaped projecting panels 92. Thus when the side cover-handles are secured in place forming the tooling utility system 72 of the invention, the side cover-handles additionally solidly lock each of the trays in position for transportation or storage.

Figure 11:
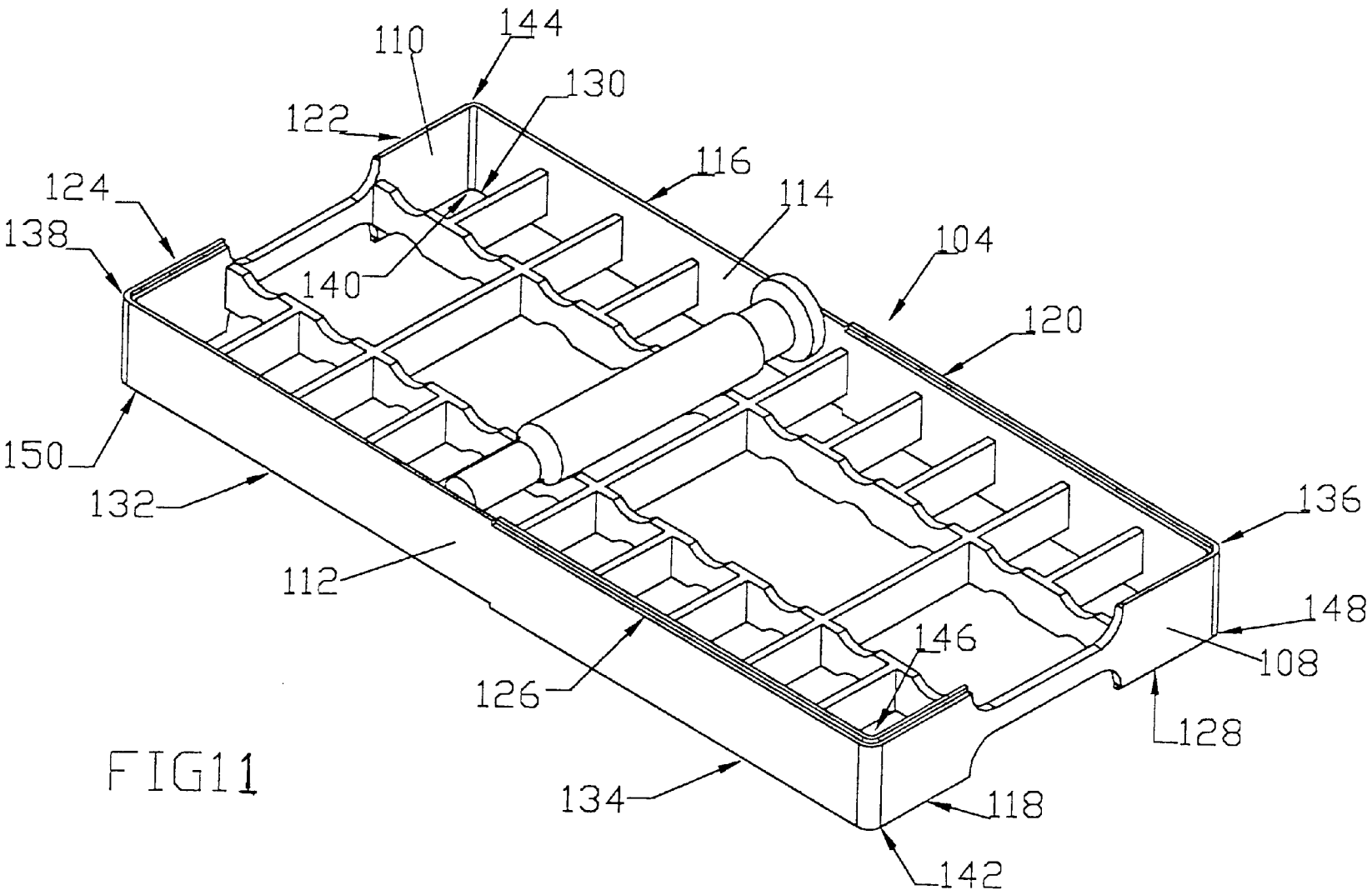
FIG. 11 is a perspective view of one version of the punch tray of the invention illustrating a tongue and groove design to facilitate tray stacking.

FIGS. 11 through 14 illustrate another feature of the present invention. In particular, they depict a preferred means for interlocking vertically adjacent trays. The means for interlocking described facilitate alignment of the trays when stacking and provide for stability of the tray arrangement when the side cover-handles are removed. FIG. 11 depicts a punch tray utilizing the preferred tongue and groove configuration for interlocking the stacked trays. Each tray includes a perimeter wall having front and back wall portions 108 and 110, and left and right wall segments 112 and 114. The top and bottom surfaces 116, 118 of the perimeter wall of the punch tray include alternating tongue and groove segments, 120, 122, 124, and 126 on the top surface 116; and, 128, 130, 132, and 134 on the bottom surface 118.

Tongue segments, for example 120, 124 are disposed about opposite corners 136 and 138 of the tray on the top surface; and tongue segments 130, 134 encompass tray comers 140 and 142 on the bottom surface 118.

Groove segments, for example 122 and 126 are disposed on the top surface 116 and encompass opposite comers 144 and 146. Groove segments 128 and 132 on the bottom surface 118 are disposed about opposite bottom comers 148 and 150.

Figure 14:
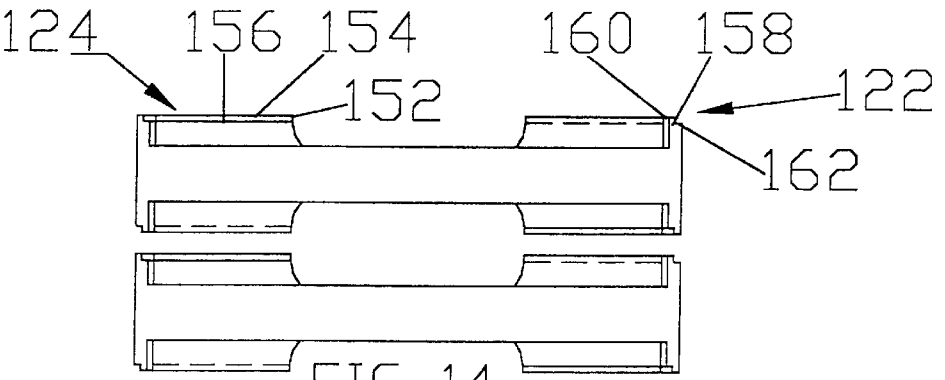
FIG. 14 is a side elevation view taken along lines 14—14 of FIG. 13.
Figure 13:
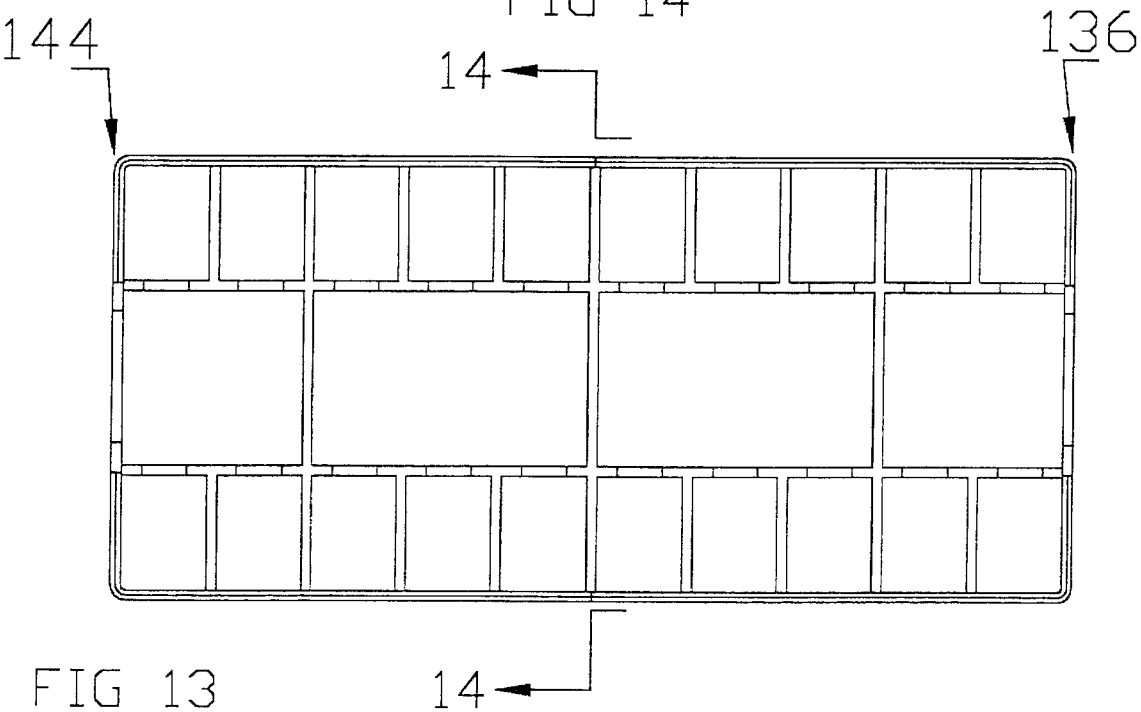
FIG. 13 is a top plan view showing stacking of at least two trays depicting the tongue and groove design of FIG. 11.

Referring to FIG. 13 and FIG. 14, each tongue section, for example 124, includes an outside vertically extending portion, for example 152, which extends between an upper horizontal surface 154 and lower horizontal surface 156. Each groove segment, for example 122 includes an inside vertically extending portion, for example 158, which extends between an upper horizontal surface 160 and lower horizontal surface 162.

Surfaces 154 and 160 are co-plainer as are surfaces 156 and 162. As seen from FIG. 14, due to the alternating arrangement of the tongue and groove configurations on opposite comers of the trays, and on both top and bottom surfaces, a particular tray can be placed on top of another tray in any one of two horizontal orientations. Also, when empty, a tray can be flipped over and positioned on the tray below because of its symmetry. Punch tooling can then be placed on the upward nesting segments.

Figure 12:
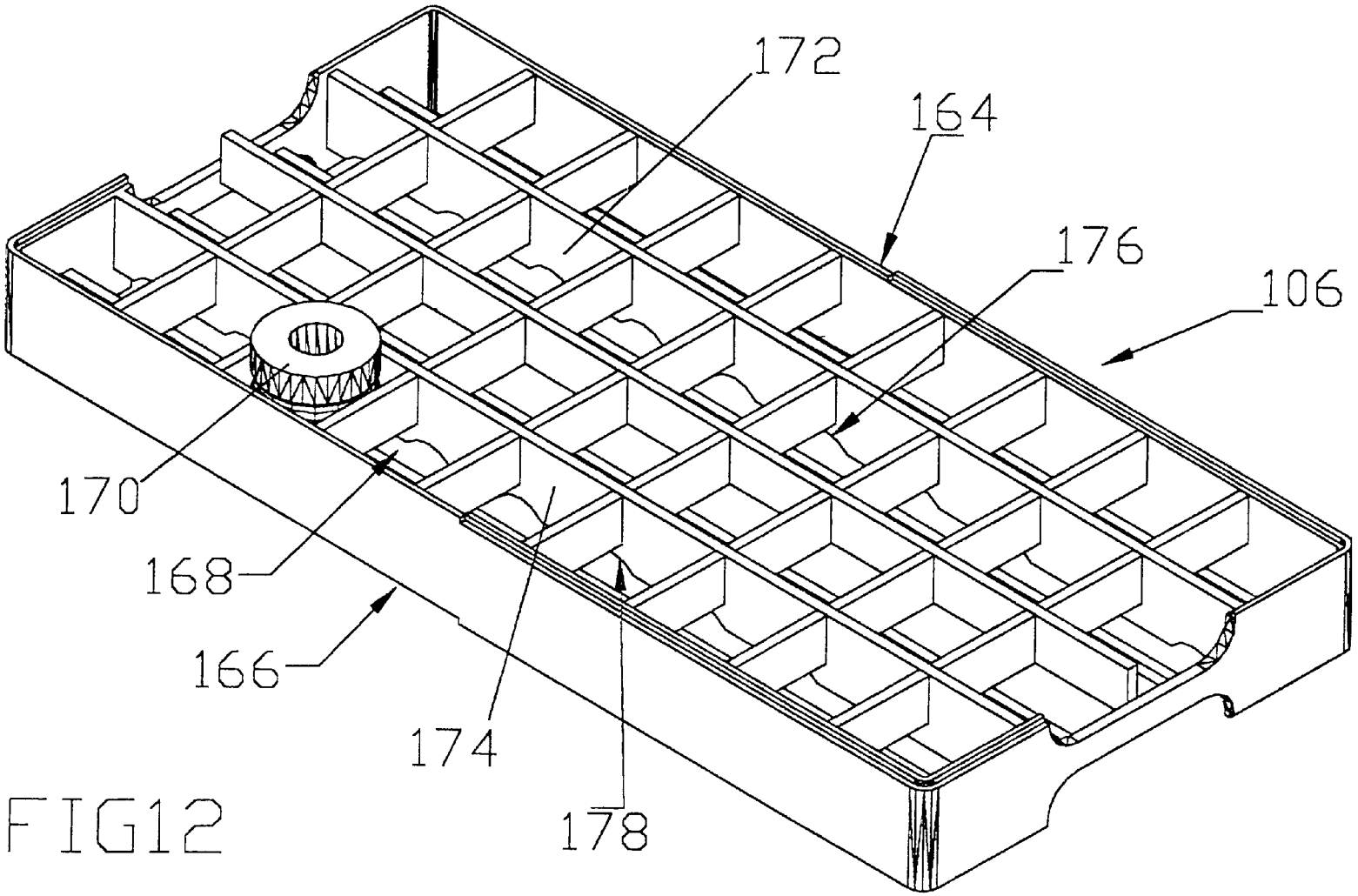
FIG. 12 is a perspective view of one version of the die tray of the invention illustrating a tongue and groove design to facilitate tray stacking.

FIG. 12 depicts a die tray 106 incorporating the tongue and groove interlocking means configured on its top and bottom surfaces 164 and 166. This die tray is somewhat different from described tray 14 above, in that the tray cavities 168 for containing the respective dies is deeper so that less than one half of the die 170 is disposed above the top surface 164. In this variation to the tooling utility system, this particular die tray would be positioned at the top of the stack and would be covered by a suitable cover such as 16 which would include a recessed under surface to accommodate the portion of the dies extending above the top surface 164. The die tray further includes support rails 172 and 174 which include a plurality of nesting segments, for example 176 and 178, disposed on their bottom surfaces to accommodate the cylindrical body portions of the punch tooling in the tray below.

Thus it can be seen the present invention provides important new conveniences for the storage of precision tools, and especially in the case of punches and dies employed in pharmaceutical tableting procedures. The unique open construction of the tool storage area provides for unimpeded tool inspection and cleaning operations, either manual or automated.

While versions of the present invention have been shown in detail, various modifications and improvements will become readily apparent to those skilled in the art. Accordingly, the spirit and scope of the present invention is to be limited only by the following claims.

What is claimed is:

1. A tooling utility system, comprising:

(a) at least one tray for holding and securing tooling, each said tray having a front side wall, a back side wall, a left side wall, and a right side wall;

(b) each said tray having a substantially open framework defining a volume encompassing said open framework, between at least two of said side walls for holding and securing tooling;

(c) a top cover means for enclosing a top surface of said at least one tray;

(d) a base cover means for enclosing a bottom surface of said at least one tray; and (e) means for clamping said top cover means, said at least one tray, and said base cover means together so as to form said tooling utility system, whereby any tooling secured within each said tray has most of an outer surface area thereof substantially exposed and accessible for inspection and cleaning while secured within each said tray said substantially open framework configured to permit the passage there through, between above and below said volume, of a cleaning fluid for cleaning tooling disposed on said open framework.

2. The tooling utility system according to claim 1, further comprising cut-out portions in said front side wall and said back side wall to provide a convenient means for hand grasping each said tray.

3. The tooling utility system according to claim 2, wherein said at least one tray comprising at least two trays including at least one punch tray and at least one die tray, each said punch tray and each said die tray configured for holding a plurality of punches and dies respectively.

4. The tooling utility system according to claim 3 wherein said top cover means and said base cover means have respective surfaces adapted to mate to a top and bottom surface of a respective tooling tray, said top cover means and said base cover means having a respective detent projection extending forward of a respective front edge and back edge, said front edge and back edge detent projections cooperatively engaging a respective apertured detent holder positioned at each of the top and bottom surfaces of a pair of side cover-handles, each said apertured detent holder, said detent projections, and said side cover-handles thereby comprising said means for clamping so as to form said tooling utility system.

5. The tooling utility system according to claim 3 wherein each said punch tray's substantially open framework includes parallel and oppositely positioned pairs of arcuate segments acting as pairs of nesting segments disposed on both top and bottom surfaces of said substantially open framework, each of said arcuate segments having a radius approximating the radius of a cylindrically shaped body portion of the punches, the number of said pairs of nesting segments being determined by the number of the punches to be held in said punch tray, each one of the punches being positioned horizontally across each pair of nesting segments, half of said diameter of said body portion of the punches extending above a top edge of said walls of each said punch tray, so that when a series of said punch trays are loaded with the punches and an upper tray is nested vertically on top of a lower tray, the punches in said lower tray are secured in position between top and bottom nesting segments in said lower and upper trays respectively.

6. The tooling utility system according to claim 5 wherein each said die tray's substantially open framework is comprised of a gridwork forming a series of cavities for securing a die within each one of said cavities, each cavity having structural means for supporting a die in said cavity so that the die is held within said cavity in a manner to expose most of an outer surface area of the die.

7. The tooling utility system according to claim 6 therein said substantially open framework of each said punch tray and each said die tray allows for the outer surface area of the punches and the dies stored therein respectively to be substantially exposed for inspection and cleaning procedures without removal of the punches and dies from their respective trays.

8. The tooling utility system according to claim 2 wherein said top cover means and said base cover means have respective surfaces adapted to mate to a top and bottom surface of a respective tooling tray, said top cover means and said base cover means having a respective detent projection extending forward of a respective front edge and back edge, said front edge and back edge detent projections cooperatively engaging a respective apertured detent holder positioned at each of the top and bottom surfaces of a pair of side cover-handles, each said apertured detent holder, said detent projections, and said side cover-handles thereby comprising said means for clamping so as to form said tooling utility system.

9. The tooling utility system according to either claim 1 or claim 3 further comprising a pair side cover-handles, and wherein said top cover means includes an underlying surface adapted to mate with a top surface of a respective tooling tray, said top cover means having a pair of apertured detent holders, each of said apertured detent holders respectively, extending a spaced distance forward of both a front edge of said top cover means and a back edge of said top cover means, said base cover means having a flat surface adapted to mate with a bottom surface of a respective tooling tray, said base cover means having a hinge first portion at both a front side edge and a back side edge thereof, each of said pair of side cover-handles hingedly connected to a respective one of said hinge first portions, each of said pair of side cover-handles rotatable upwards about its hinged connection with a respective one of said hinge first portions, until a detent projection on a top surface of each one of said pair of side cover-handles engages each respective said apertured detent holder on said front and back edges of said top cover means, said detent projections, said apertured detent holders, said hinges, and said side cover-handles thereby comprising said means for clamping so as to form said tooling utility system.

10. The tooling utility system claimed in claim 9 wherein the top and bottom surfaces of each said tray include means for interlocking the top surface of a lower tray with the bottom surface of an upper tray when said trays are stacked vertically, whereby the upper and lower trays are maintained in a stable, fixed relationship one to the other.

11. The tooling utility system claimed in claim 10 wherein said means for interlocking include alternating tongue and groove configurations disposed about the perimeter of the top surface and alternating tongue and groove configurations disposed about the perimeter of the bottom surface of each tray.

12. The tooling utility system according to either claim 1 or claim 3 wherein said top cover means and said base cover means have respective surfaces adapted to mate to a top and bottom surface of a respective tooling tray, said top cover means and said base cover means having a respective detent projection extending forward of a respective front edge and back edge, said front edge and back edge detent projections cooperatively engaging a respective apertured detent holder positioned at each of the top and bottom surfaces of a pair of side cover-handles, each said apertured detent holder, said detent projections, and said side cover-handles thereby comprising said means for clamping so as to form said tooling utility system.

13. The tooling utility system claimed in claim 12 wherein the top and bottom surfaces of each said tray include means for interlocking the top surface of a lower tray with the bottom surface of an upper tray when said trays are stacked vertically, whereby the upper and lower trays are maintained in a stable, fixed relationship one to the other.

14. The tooling utility system claimed in claim 13 wherein said means for interlocking include alternating tongue and groove configurations disposed about the perimeter of the top surface and alternating tongue and groove configurations disposed about the perimeter of the bottom surface of each tray.

15. The tooling utility system according to either claim 8 or 4, further comprising a series of projecting panels on the side of said side cover-handles facing said front side wall and said back side wall of said tooling trays, said projecting panels matching said cut-out portions in said front and back walls of said tooling trays, said projecting panels having grooves and ridges cut into the lateral edges of said projecting panels which cooperate with matching grooves and ridges cut into the lateral edges of said cut-out portions, so that when said projecting panels are snapped in place into said cut-out portions on said front and back sides of said tooling trays, said tooling trays are further secured against movement when said tooling utility system is handled or transported.

16. The tooling utility system according to claim 15, further comprising a gridwork on the sides of said side cover-handles facing away from said front side wall and said back side wall of said tooling trays, said gridwork forming convenient hollow slots for the placement of a user's fingers to facilitate the lifting and transporting of the tooling utility system.

17. A tooling utility system for storing punches and dies used in pharmaceutical tableting procedures, comprising:

(a) a plurality of tooling trays for holding and securing punches and dies, including a plurality of punch trays and at least one die tray, each of said punch trays and said at least one die tray having the same dimensioned front side wall, back side wall, left side wall, and right side wall;

(b) each of said punch trays and said at least one die tray having substantially open respective internal framework defining a volume encompassing said open framework between said walls for holding and securing punches and dies;

(c) said internal framework of each of said punch trays providing a means for holding and securing punches in a horizontal position within said trays at two areas along a length of a cylindrical body portion of a punch, approximately one-half of each punch extending above a top edge of said punch tray when in said horizontal position;

(d) said internal framework of said at least one die tray forming a plurality of cavities, each said cavity providing a means for holding a respective die when dies are placed within said cavities;

(e) a top cover for enclosing the top surface of an uppermost one of said tooling trays;

(f) a bottom cover for enclosing the bottom surface of one of said tooling trays; and, (g) means for clamping said top cover, said punch trays, said at least one die tray, and said bottom cover together so as to form said tooling utility system, a respective number of punches, when said plurality of punch filled trays and said at least one die tray are nested together in a vertical column, disposed in a vertically lower one of said punch trays and having another upper punch tray immediately, vertically above said lower one of said punch trays, said respective number of punches being secured between the respective means for holding and securing formed by said respective internal framework of each of said lower and upper punch trays, a substantial portion of the external area of punches being exposed for inspection and cleaning procedures, a die being held within each said cavity within said at least one die tray, a substantial portion of the external area of each die being exposed for inspection and cleaning said substantially open framework configured to permit the passage there through, between above and below said volume, of a cleaning fluid for cleaning tooling disposed on said open framework.

18. The tooling utility system claimed in claim 17 further including a pair of side cover-handles wherein said top cover means includes an underlying surface adapted to mate with a top surface of a respective tooling tray, said top cover means having a pair of apertured detent holders extending a spaced distance forward of both a front edge of said top cover means and a back edge of said top cover means, said base cover means having a flat surface adapted to mate with a bottom surface of a respective tooling tray, said base cover means having a hinge first portion at both a front side edge and a back side edge thereof, each of said pair of side cover-handles hingedly connected to a respective one of said hinge first portions, each of said pair of side cover-handles rotatable upwards about its hinged connection with a respective one of said hinge first portions, until a detent projection on a top surface of each one of said pair of side cover-handles engages each respective said apertured detent holder on said front and back edges of said top cover means, said detent projections, said apertured detent holders, said hinges, and said side cover-handles thereby comprising said means for clamping so as to form said tooling utility system.

19. The tooling utility system claimed in claim 17 wherein said top cover means and said base cover means have respective surfaces adapted to mate to a top and bottom surface of a respective tooling tray, said top cover means and said base cover means having respective detent projections extending forward of a respective front edge and back edge, said front edge and back edge detent projections cooperatively engaging a respective apertured detent holder positioned at each of the top and bottom surfaces of a pair of side cover-handles, each said apertured detent holder, said detent projections, and said side cover-handles thereby comprising said means for clamping so as to form said tooling utility system.

20. The tooling utility system according to claim 19, further comprising cut-out portions in said front side wall and said back side wall to provide a convenient means for hand grasping each tray and a series of projecting panels on the side of said side cover-handles facing said front side wall and said back side wall of said tooling trays, said projecting panels matching said cut-out portions in said front and back walls of said tooling trays, said projecting panels having grooves and ridges cut into the lateral edges of said projecting panels which cooperate with matching grooves and ridges cut into the lateral edges of said cut-out portions, so that when said projecting panels are snapped in place into said cut-out portions on said front and back sides of said tooling trays, said tooling trays are further secured against movement when said tooling utility system is handled or transported.

21. The tooling utility system according to claim 20, further comprising a gridwork on the sides of said side cover-handles facing away from said front side wall and said back side wall of said tooling trays, said gridwork forming convenient hollow slots for the placement of a user's fingers to facilitate the lifting and transporting of the tooling utility system.

22. The tooling utility system claimed in either claim 1, 3, 5, 7 or 17 wherein the top and bottom surfaces of each said tray include means for interlocking the top surface of a lower tray with the bottom surface of an upper tray when said trays are stacked vertically, whereby the upper and lower trays are maintained in a stable, fixed relationship one to the other.

23. The tooling utility system claimed in claim 22 wherein said means for interlocking include alternating tongue and groove configurations disposed about the perimeter of the top surface and alternating tongue and groove configurations disposed about the perimeter of the bottom surface of each tray.

* * * * *

UNITED STATES PATENT AND TRADEMARK OFFICE

CERTIFICATE OF CORRECTION

PATENT NO. : 5,950,828

DATED : September 14, 1999

INVENTOR(S) : Gregory W. Bal, Montvale, New Jersey

It is certified that error appears in the above-identified patent and that said Letters Patent is hereby corrected as shown below:

At Column 9, line 35, insert a comma after the word "tray".

At Column 10, line 20, change the word "therein" to --wherein--.

Signed and Sealed this

Twentieth Day of June, 2000

*Attest:*

Q. TODD DICKINSON

*Attesting Officer*

*Director of Patents and Trademarks*